United States Patent [19]

Kreuzer et al.

[11] Patent Number: 4,763,727

[45] Date of Patent: Aug. 16, 1988

[54] PANEL HEAT EXCHANGER

[75] Inventors: Walter Kreuzer, Leonberg; Kurt Bubeck, Rutesheim; Karl H. Staffa, Stuttgart, all of Fed. Rep. of Germany

[73] Assignee: Süddeutsche Kühlerfabrik Julius Fr. Behr GmbH & Co. KG, Fed. Rep. of Germany

[21] Appl. No.: 940,083

[22] Filed: Dec. 10, 1986

[30] Foreign Application Priority Data

Dec. 10, 1985 [DE] Fed. Rep. of Germany ..... 3543541

[51] Int. Cl.[4] ..... F28F 1/32

[52] U.S. Cl. ..... 165/171; 165/168; 29/157.3 C

[58] Field of Search ..... 165/171, 168; 29/157.3 C

[56] References Cited

U.S. PATENT DOCUMENTS

| | | | |
|---|---|---|---|
| 1,737,759 | 12/1929 | Harter | 165/171 X |
| 2,171,790 | 9/1939 | Higham et al. | 165/171 X |
| 2,567,716 | 9/1951 | Kritzer | 165/171 |
| 2,666,981 | 1/1954 | Sandberg | 29/157.3 |
| 2,722,732 | 11/1955 | Sandberg | 165/171 X |
| 2,823,522 | 2/1958 | Collins | 165/171 X |
| 2,877,631 | 3/1959 | McLean, Jr. | 62/526 |
| 2,913,806 | 11/1959 | Kritzer | 29/33 G |
| 3,258,204 | 6/1966 | Smith, Jr. | 165/171 X |
| 3,460,613 | 8/1969 | Kritzer | 165/171 X |
| 3,827,485 | 8/1974 | Hickman et al. | 165/171 |
| 3,858,647 | 1/1975 | Hickman et al. | 165/171 |
| 4,122,830 | 10/1978 | Hapgood | 165/171 X |
| 4,149,524 | 4/1979 | Severson | 165/171 X |
| 4,182,013 | 1/1980 | Grossman | 165/171 X |

FOREIGN PATENT DOCUMENTS

| | | | |
|---|---|---|---|
| 496027 | 9/1953 | Canada | 165/171 |
| 157370 | 10/1985 | European Pat. Off. . | |
| 575272 | 4/1933 | Fed. Rep. of Germany . | |
| 8304603 | 5/1985 | Fed. Rep. of Germany . | |
| 3308329 | 5/1986 | Fed. Rep. of Germany . | |
| 1171814 | 1/1959 | France . | |
| 1498525 | 9/1967 | France . | |
| 57-72737 | 5/1982 | Japan . | |
| 348358 | 5/1931 | United Kingdom | 165/171 |
| 1530925 | 11/1978 | United Kingdom . | |

*Primary Examiner*—Ira S. Lazarus
*Assistant Examiner*—Richard R. Cole
*Attorney, Agent, or Firm*—Barnes & Thornburg

[57] ABSTRACT

A panel heat exchanger is provided that has a plate made of a heat-conducting material and at least one pipe connected with it, this pipe having a meandering shape, and through which a heat exchange medium flows. The plate is provided with slots the width of which is adapted to the diameter of the pipe. The pipe is inserted into the slots approximately flush with the plate and is held by deformations extending transversely to its longitudinal axis at the slot edges in a form-fitting way.

11 Claims, 3 Drawing Sheets

Fig. 1
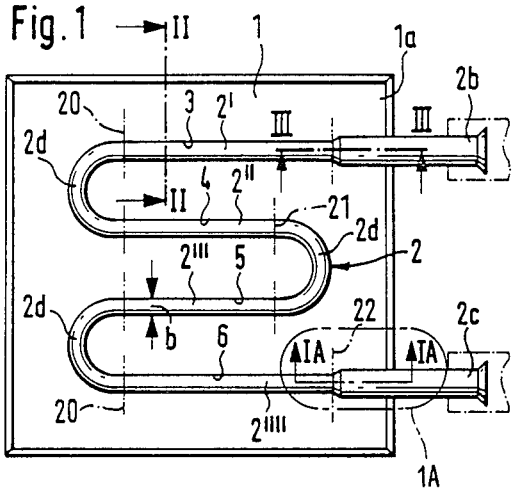
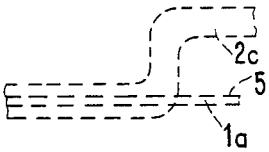
FIG. 1A
Fig. 2
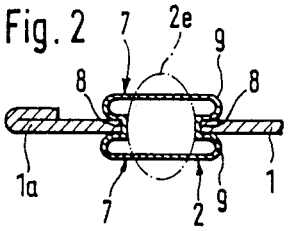
Fig. 3
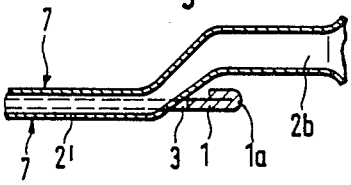
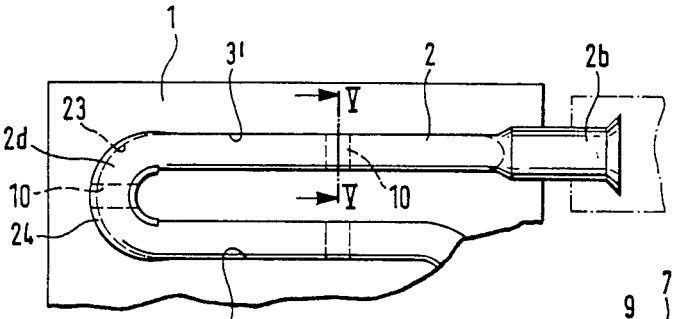
Fig. 4
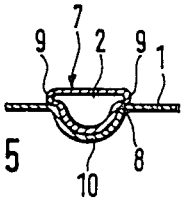
Fig. 5

Fig. 6
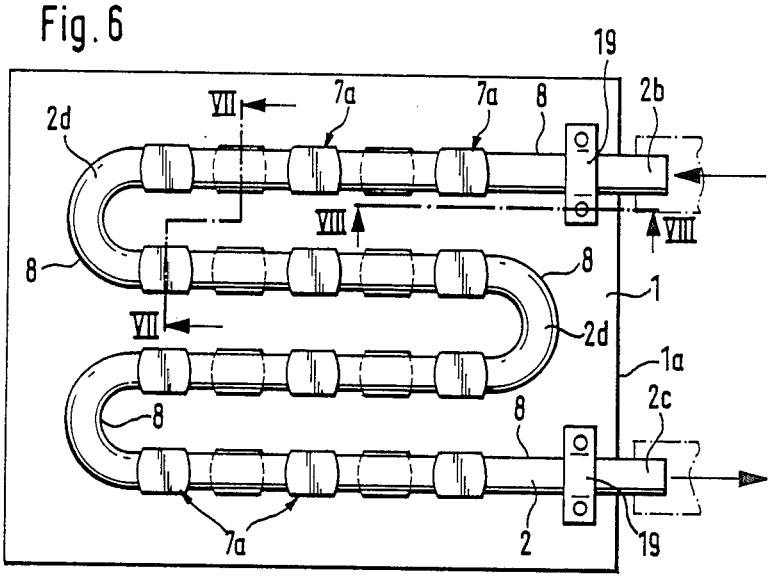
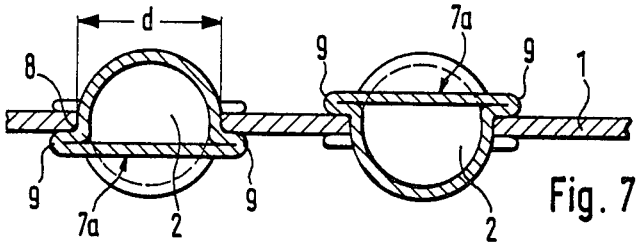
Fig. 7
Fig. 8
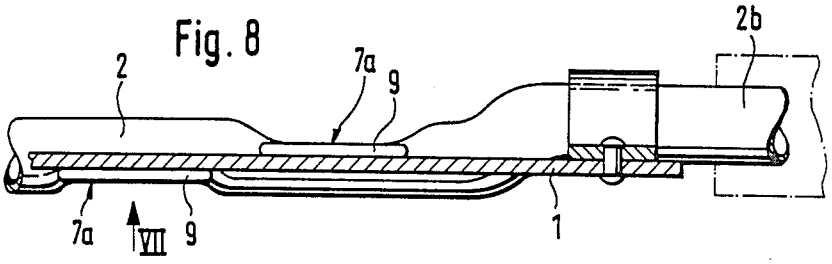

Fig. 9
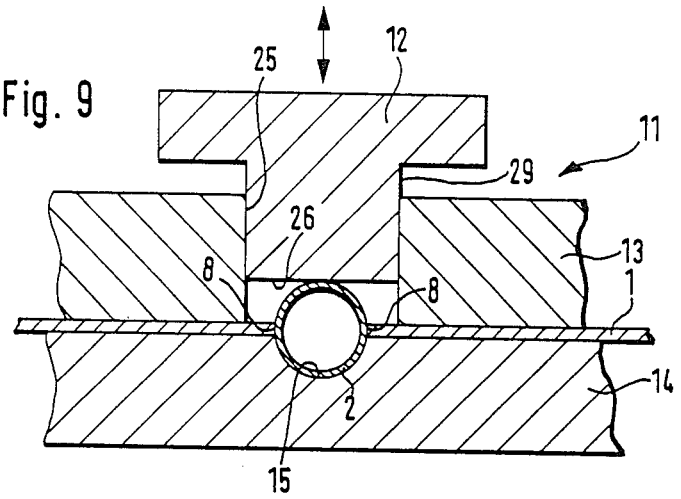
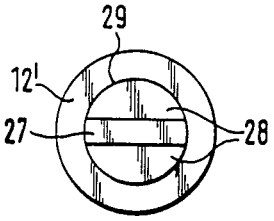
Fig. 10
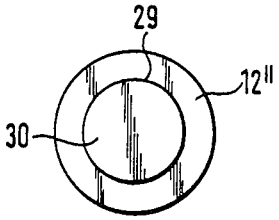
Fig. 11
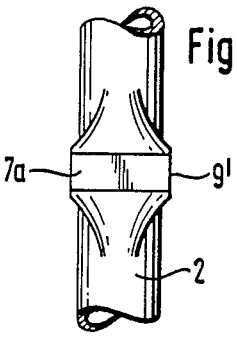
Fig. 12
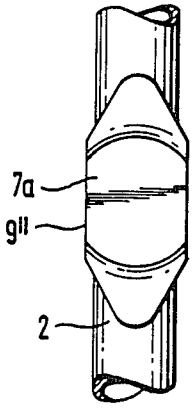
Fig. 13

PANEL HEAT EXCHANGER

BACKGROUND AND SUMMARY OF THE INVENTION

This invention relates to a panel heat exchanger having a plate made of a heat-conducting material and at least one pipe connected with it, particularly in a meandering shape, through which a heat exchange medium can flow.

Panel heat exchangers of this type are shown in German Utility Model 8,304,603. In the exchanger of that reference, coiled pipes are provided that are bent in a meandering shape. These pipes are fastened at carrier sheets consisting preferably of aluminum or aluminium forging alloys by clamps that are punched out of the plane of the carrier sheets and are placed around the pipes. The pipes that are fixed at the plate advantageously have a triangular cross-section for better fastening, and may subsequently be covered by a second plate. Exchangers of this construction have a disadvantage in that when this type of panel heat exchanger is installed, the lugs and holding clamps may represent a danger that could result in injury. For this reason, the second covering plate must be provided, and the heat transfer between the pipe and the plate is not sufficient because of the relatively small contact surfaces between the clamps and the pipe.

A panel heat exchanger in which the coiled pipe is glued to the carrier sheet is shown in German Published Application 3,308,329. That panel heat exchanger has a disadvantage in that there is a poor heat transfer between the coiled pipe and the plate because the glue has low thermal conductivity. It also has the disadvantage that, in manufacturing, the coiled pipe and the carrier plate must remain braced with respect to one another during the hardening process of the glue. This process is expensive and, because of the hardening time, makes series production less attractive. In addition, such a glued connnection is not sufficiently reliable for highly stressed products, such as, for example, are used in motor vehicles.

The present invention has an objective of providing a panel heat exchanger of the initially-described type that is simple to manufacture but nevertheless ensures a good heat transfer between the pipe and the carrier plate.

This and other objects of the present invention are attained in a panel heat exchanger provided with slots for receiving a pipe so that the pipe is inserted into the slots approximately flush with the plate. The pipe has deformations extending transversely to its longitudinal axis, and is thereby held at the slot edges.

The deformations held at opposite exterior sides of the pipe, create continuous contact surfaces between the pipe and the carrier plate that ensure a good heat transfer, as is the case between the ribs connected to a pipe. The manufacturing of the new panel heat exchanger, according to the invention, however, requires neither gluing nor soldering and can be carried out in a simple way.

The heat transfer between the pipe and the plate may also be improved in certain preferred embodiment by selecting the width of the slots to be slightly smaller than the pipe diameter. As a result, there occurs during the positioning of the pipes in the slots of the plate, a certain deforming of the slot edges that place themselves continuously against the shell of the pipe. If the deformations are provided with creases that overlap the opposite slot edges, a stable closure is created in addition to the frictional connection between the pipe and the slots. The panel heat exchanger is thus extremely sturdy and has excellent heat transfer characteristics.

It is advantageous, in certain preferred embodiments, not to let the slots for the insertion of the pipe or the coiled pipe extend to the edge of the plate. In these embodiments, at least the two connecting ends of the pipe are led out of the plane of the plate bent at approximately right angles. The plate itself may therefore be very sturdy because the slots for the inserting of the pipe or pipe coil are located only within the plate surface so that the plate retains a stiff surrounding edge.

In preferred embodiments in which the pipe has a serpentine shape with straight legs that extend in parallel to one another, it is advantageously provided in certain of these embodiments, to hold only these straight legs in parallel slots within the plate. The connecting arches of these straight legs project at a right angle out of the plane of the plate and only rest on the plate. It was found that the resulting loss of heat-transferring contact surfaces in these embodiments is not so large so as to outweigh the resulting simplification of manufacture. Mainly, it is very simple for this embodiment to provide the creases on both sides of the plate so that the pipe in the area of its parallel legs rests not only against the front sides of the slot edges but via the creases also against the edge areas of the plate that are adjacent to the slot. As a result, the heat transfer area is clearly enlarged.

In another preferred embodiment, the slots are interrupted by transverse webs which are deformed to be semicircular either before or during insertion of the pipes. In this case, the pipe will be provided with creases only on the side of the plate that is opposite the transverse webs. It is also contemplated to provide such a construction in the area of the connecting arches of the serpentine-shaped bent pipe so that it is not necessary to lead the connecting arches out of the plane of the plate bent at a right angle. Nevertheless, in the area of the connecting arches, a crease arrangement that extends at both sides does not need to be provided, the manufacturing of which is possible but in view of a later bending of the plate for the adaption to installation conditions, is not advantageous.

In a further preferred embodiment, the deformations are arranged only at separate points at distances behind one another along the pipe, in which case adjacent deformations are also arranged alternating on one or the other side of the pipe projecting out of the plane. This has the advantage that the fastening of the pipe in this manner in the slot can take place largely without concern for tolerances, namely in the area of the connecting arches of serpentine-shaped bent pipes. In this type of deforming of a pipe in serpentine shape, it is contemplated that the slot therefore also have a shape that is adapted to this serpentine shape.

For the manufacturing of the preferred embodiment of a panel heat exchanger according to the present invention, a device with a holder for holding the plate, and a die movable with respect to the holder was found to be particularly advantageous. By means of this device, the coiled pipe can first be positioned in the carrier plate and can subsequently be fastened in a form-fitting way.

Further objects, features, and advantages of the present invention will become more apparent from the following description when taken with the accompanying drawings, which show for purposes of illustration only, preferred embodiments constructed in accordance with the present invention.

BRIEF DESCRIPTION OF THE DRAWINGS

FIG. 1 is a schematic top view of a panel heat exchanger constructed in accordance with a preferred embodiment of the present invention;

FIG. 1A is a sectional schematic view of area 1A of FIG. 1 taken along section line 1A—1A and depicting an alternative embodiment of the present invention;

FIG. 2 is an enlarged partial sectional view through the panel heat exchanger of FIG. 1 taken along Line II—II;

FIG. 3 is an enlarged partial sectional view through FIG. 1 taken along Line III—III;

FIG. 4 is a partial top view of a panel heat exchanger constructed in accordance with an alternate preferred embodiment of the present invention;

FIG. 5 is a partial sectional view through the heat exchanger of FIG. 4 taken along Line V-V;

FIG. 6 is a top view of a further preferred embodiment of a panel heat exchanger;

FIG. 7 is a sectional view through the panel heat exchanger of FIG. 6 taken along Line VII—VIII;

FIG. 8 is a partial sectional view through the panel heat exchanger of FIG. 6 along Line VIII—VIII;

FIG. 9 is a schematic view of an arrangement for the manufacturing of a panel heat exchanger according to FIG. 6;

FIG. 10 is a schematic front view of a preferred embodiment of a deformation die that can be used in the arrangement of FIG. 6;

FIG. 11 is a schematic front view of an alternate preferred embodiment of a deformation die;

FIG. 12 is a view of a preferred embodiment of a deformation point of the pipe of the panel heat exchanger of FIG. 6, viewed in the direction of Arrow XIII in FIG. 8; and FIG. 13 is a view of an alternate preferred embodiment of a deformation point of the pipe of the panel heat exchanger of FIG. 6, viewed in the direction of Arrow XII in FIG. 8.

DETAILED DESCRIPTION OF THE DRAWINGS

In FIG. 1, in a plate 1, which in preferred embodiments is made of aluminum, four slots 3, 4, 5 and 6 are arranged that extend parallel to one another and do not reach the edge 1*a* of the plate. In the illustrated embodiment, the slots 3 and 6 are slightly longer than the slots 4 and 5. As viewed in FIG. 1, the slots 3 and 6 both extend on their left side to the borderline 20, as indicated by an interrupted line. The slots 4 and 5 also extend from borderline 20. However, on the right side, the slots 3 and 6 extend approximately to the borderline 22, while the slots 4 and 5 extend only to the outlined borderline 21.

Straight legs 2', 2'', 2''' and 2'''' of a serpentine-shaped bent pipe 2 are inserted into slots 3–6 such that the pipe 2 in each case is held at diametrically opposite points of its diameter between the opposing slot edges 8 of each slot 3–6. The two open connecting ends 2*b*, 2*c* are led out of the plane of the plate at approximately right angles. FIG. 1A schematically depicts a right angle bend configuration of the connection end 2*c*. In FIG. 3, only connecting ends 2*b* is shown being led out for purposes of clarity. It is contemplated in the pipe bend areas to provide, in certain preferred embodiments, that the connecting arches 2*d* between the legs 2', 2'' or 2''' and 2'''' be led out of the plane of the plate.

The width b of the slots 3–6 in the illustrated embodiment is selected to be somewhat smaller than the diameter d that is only shown in FIG. 7 of the pipe 2. This is so that, as shown in FIG. 2, the pipe 2, which before the pressing of its straight legs into the slots 3–6 had received an oval shape, is pressed into the slots so that its widest point rests firmly against the opposite slot edges 8. In FIG. 2, the oval shaped pipe has a reference numeral 2*e*. The pipe 2 also is in contact with the slot edges 8 which makes possible a good heat transfer between the adjacent plate 1 and the heat exchange medium that is fed through the pipe 2. As shown in FIG. 2, the longitudinal axis of the pipe 2 in its position 2*e* lies in the central plane of the plate 1. In the following, this arrangement is referred to as the pipe being located in the plane of the plate.

As also shown in FIG. 2, however, the shape 2*e* of the pipe 2 is not the final shape for the form-fitting fastening of the pipe 2 in the slots 3–6 of the plate 1. Rather, in this embodiment, the pipe legs 2', 2'', 2''', and 2'''', from the direction of both plate sides, are provided with a continuous deformation 7. This deformation 7 takes the form of continuous flattenings on both sides of the area of the slot edges 8, the deforming producing creases 9 that closely reach around the slot edges 8 from both sides of the plate 1. The squeezed pipe is therefore seated in the plate in a form-fitting and tight way.

The contact area between the plate 1 and the pipe 2, formed by the creases 9 and their contact surfaces at the plate 1, are significantly larger than the front surfaces of the slot edges 8. This provides an excellent heat transfer during operation. It is also contemplated to squeeze only the straight pipe legs extending parallel to one another since this is easier to carry out. For the case of the panel heat exchanger shown in FIG. 1, the pipe legs 2', 2'', 2''' and 2'''' would then be located in the plane of the plate, while the connecting arches 2*d* are extended out of this plane of the plate either in upward or downward direction. These arches extend either from the side of the plate 1 from which the connecting ends 2*b*, 2*c* extend or from the opposite side of the plate 1.

In FIGS. 4 and 5, another preferred embodiment of a panel heat exchanger is shown. This embodiment is similar to the embodiment of FIG. 1, having a single continuous slot having straight segments 3', 4' and slot parts 23 connecting these two in an arched shape. Into this continous slot, the serpentine-shaped bent pipe 2 is inserted such that the coiled pipe is disposed in the plane of the plate, with the exception of its connecting ends 2*b* which project out of the plane of the plate bent at right angles to the outside, as in FIG. 3.

For the embodiment of FIG. 4, the pipe 2 is secured in place by transverse webs 10 that subdivide the slots 3', 23 and 4'. These transverse webs 10 are deformed downward in a semicircular shape before or during the insertion of the pipe 2. The deformation may also take place such that slightly mor than half of the circumference of pipe 2 enters into the range of the transverse webs 10 and is held firmly in this position by the deformation taking place during the insertion. The upper side of the pipe 2 may again be provided with deformations 7 in the shape of continuous flats so that the creases 9 form on the upper side of the plate 1. In addition, it is contemplated to arrange the pipe arches *2d* toward the side of the plate 1 facing away from the transverse webs 10 by clamping tabs 24 that are punched out of the plate 1 and are partially over the circumference of the pipe placed in the area of the connecting arch *2d*. A similar fixing is also contemplated for the connecting ends *2b*.

Another advantageous preferred embodiment of a panel heat exchanger is shown in FIGS. 6 to 8. In this embodiment, as in the embodiment of FIG. 4, the slot extending in serpentine shape within the plate 1 corresponds to the serpentine shape of pipe 2. Likewise, the slot is exclusively arranged within the plate 1 and a surrounding edge *1a* will remain. The connecting ends *2b* and *2c* in this embodiment, are also led out of the plane of the plate, as shown in FIG. 3. However, the connecting ends *2b* and *2c*, in this embodiment, are secured in the area of the edge *1a* of the plate 1 by riveted-on brackets 19.

The pipe 2 lies completely in the plane of the plate (except for connecting ends *2b* and *2c*). However, in this embodiment, the pipe is provided with squeezed areas only at squeezed points *7a* and not continuously over the whole length of the pipe 2. This is shown in detail in FIGS. 7 and 8.

These squeezed points *7a* are arranged along the pipe separated a distance from one another. Also, adjacent squeezed points *7a* with the resulting creases 9 are provided at the pipe 2 from opposite sides of the plate 1, so that the pipe 2 has contractions that alternately project into the free cross-section of the pipe 2. These alternating contractions affect the heat exchange medium flowing through the pipe 2 in the manner of flow baffles that create turbulence in the medium and therefore provides an improvement of the heat transmission coefficient. The alternating squeezing by means of the squeezed points *7a* is also sufficient for providing a secure fastening of the pipe 2 over its whole length in the plane of the plate. It is advantageous in this embodiment to also provide squeezed points in the area of the connecting arches *2d*, although this is not illustrated. The intimate contacting of the exterior walls of the pipe 2 with the slot edges 8 creates a sufficient heat transfer between the pipe 2 and the plate 1.

In FIGS. 9 to 11, an arrangement for the manufacturing of a panel heat exchanger according to FIGS. 6 to 8 is shown diagrammatically. The arrangement comprises two blocks 13 and 14 that can be moved against one another. Between these blocks 13 and 14, the plate 1 with the serpentine-shaped pipe 2 that was previously provided with punched-out slots is inserted. In this arrangement, the serpentine-shaped pipe 2 is not yet brought into the position shown in FIG. 9. The serpentine-shaped pipe 2, when the blocks 13 and 14 are moved apart, is first located above the plane of the plate 1 so that only part of its respective circumference projects into the punched-in slots. The blocks 13 and 14 each have recesses 15 that correspond to the course of the pipe coil and the course of the slots. The recesses 15 have a cross-section that corresponds approximately to half the contour of the pipe 2 to be inserted.

In the illustrated embodiment, the recesses 15 have a semicircular cross-section. When the blocks 13 and 14 are moved together until they rest against the plate 1, the round pipe 2 as a result is pushed into the plane of the plate. Thus, the round pipe 2, similar to the embodiment of FIG. 1, is clamped between the diametrically opposite slot edges 8 at its widest point.

In the blocks 13 and 14, bores 25 along the recesses 15 are distributed at a corresponding distance in which dies 12 are guided. In a manner that is not shown in detail, the dies 12 can be acted upon from the outside by a force and are pressed in the direction toward the pipe 2. In this embodiment, the dies 12 are provided in the upper block 13 as well as in the lower block 14, although this is not shown in FIG. 9.

By means of the application of pressure to these dies 12, squeezed points *7a* are provided at the pipe 2 alternating on both sides. The squeezed points *7a* receive different shapes, depending on the shape of the front surface 26 of the die 12. If, for example, a die 12' is used that has a front surface 27 as shown in FIG. 10, which is an approximately rectangular shape with diagonal surfaces 28 that toward the rear changes into the cylinder-shaped part 29, squeezed points *7a* are obtained at both sides of the pipe that have approximately the appearance shown in FIG. 12.

If, however, a die 12'' having a circular front surface 30 is provided that extends vertically to the cylindrical part 29, squeezed points *7a* are obtained that, viewed perpendicularly to the plane of the plate, have the appearance shown in FIG. 13. The squezed points *7a* according to FIG. 13 have longer creases 9'' that overlap the plate in contrast to the embodiment of FIG. 12 where the creases 9' remain relatively short. However, the squeezing forces required to be applied for the FIG. 13 embodiment are more than in the embodiment of FIG. 12. If desired, the distance between the alternating squeezed points in the FIG. 12 embodiment may be selected to be smaller than in the embodiment according to FIG. 13 in order to keep the heat-transferring surface between the pipe 2 and the plate 1 as large as possible.

Instead of the illustrated type of fastening by point-shaped squeezing, a combination of such a point-shaped squeezing and a continuous squeezing is contemplated. In that case, the point-shaped squeezing could, for example, take place in the area of the pipe arches and the continuous squeezing of the pipe could take place in the area of the straight legs.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. A panel heat exchanger comprising:

heat conducting plate means having slot means therein which extend between oppositely facing planar surface sections of the plate means; and pipe means for carrying heat exchange medium, said pipe means including tubular wall means disposed in the slot means with tubular wall portions extending outwardly of the slot means beyond both planar surface sections of the plate means, said pipe means being secured to the plate means by deformation of the tubular wall means clampingly engaging the plate means at the slot means.

2. A panel heat exchanger according to claim 1, wherein said slot means have a width that is smaller than a diameter of the pipe means.

3. A panel heat exchanger according to claim 2, wherein the deformations have creases that overlap opposite edges of said slot means.

4. A panel heat exchanger according to claim 3, wherein the slot means end spaced from edges of the plate means and wherein at least two connecting ends of said pipe means are led out of the plane of the plate means bent at right angles.

5. A panel heat exchanger according to claim 4, wherein the pipe means has a serpentine shape with straight legs extending parallel to one another.

6. A panel heat exchanged according to claim 5, wherein at least a portion of said slot means are parallel slots, and wherein said pipe means has connecting bends which extend out of the plane of the plate means bent at approximately right angles.

7. A panel heat exchanger according to claim 6, wherein the creases are provided continuously on both sides of the plate means.

8. A panel heat exchanger according to claim 4, wherein the slot means are interrupted by transverse webs which are deformed in a semicircular shape by insertion of the pipe means, and wherein said pipe means has creases only on a side of the plate means that is opposite the transverse webs.

9. A panel heat exchanger according to claim 4, wherein the deformations are provided along the pipe means at discrete points which are separated from one another.

10. A panel heat exchanger according to claim 9, wherein the adjacent deformations are arranged alternately on one or the other side of the pipe means that projects out of the plane of the plate means.

11. A panel heat exchanger according to claim 10, wherein the pipe means has a serpentine shape and the slot means has a corresponding serpentine shape, and wherein bends of the pipe means are received approximately flush to the plane of the plate.

* * * * *